US005127992A

United States Patent [19]

Davies et al.

[11] Patent Number: 5,127,992

[45] Date of Patent: Jul. 7, 1992

[54] ELIMINATION OF BLEACH EFFLUENTS

[75] Inventors: Christopher J. Davies, Benoni; Volkmar J. Böhmer, Sundra; Michael D. Birkett, Benoni, all of South Africa

[73] Assignee: Sappi Limited, Springs, South Africa

[21] Appl. No.: 397,683

[22] Filed: Aug. 23, 1989

[30] Foreign Application Priority Data

Aug. 23, 1988 [ZA] South Africa ..... 88/6237

[51] Int. Cl.[5] ..... D21C 11/00

[52] U.S. Cl. ..... 162/29; 162/30.1; 162/31; 162/38; 162/47

[58] Field of Search ..... 162/19, 28, 88, 29, 162/30.1, 32, 87, 189, 47, 79, 86, 38; 210/928; 423/DIG. 3, 159

[56] References Cited

U.S. PATENT DOCUMENTS 3,758,405 9/1973 Fremont ..... 162/29
4,000,264 12/1976 Nagano et al. ..... 162/30.1
4,058,458 11/1977 Svarz ..... 210/928
4,070,233 1/1978 Matsuura ..... 162/28
4,259,149 3/1981 Jaszka et al. ..... 162/29
4,268,350 5/1981 Mansson ..... 162/29

OTHER PUBLICATIONS

McIlroy, "The Control of Chloride Ions in MgO Recovery System", *Tappi*, vol. 56, No. 9 (Sep. 1973) pp. 79–82.

*Primary Examiner*—Peter Chin
*Attorney, Agent, or Firm*—Browdy and Neimark

[57] ABSTRACT

A process is provided for the treatment of an acidic aqueous effluent derived from a chlorine or chlorine compound bleaching process. The acidic effluent is reacted with a neutralizing base selected from carbonates, hydroxides and oxides of Al, Cr, Co, Fe, Mg, Mn, and Ni. The neutralized effluent is concentrated and residual base and HCl are subsequently recovered. The concentration of neutralized effluent may be accomplished by passing the neutralized effluent through the cooling tower of the pulp mill.

25 Claims, 2 Drawing Sheets

ELIMINATION OF BLEACH EFFLUENTS

This invention relates to a process for the treatment of effluent originating from the chlorine or chlorine compound bleaching of cellulose pulp, for the recovery of chemicals therefrom and the elimination of liquid waste disposal.

Most cellulosic pulp bleaching processes utilise chlorine or chlorine-containing chemicals in the bleaching sequence with the result that the spent bleaching liquors present the major pollution load from the pulp bleaching mill. Chlorinated organic compounds, such as dioxin, as well as many other components of the effluent are known to be toxic, whereas inorganic chlorine waste components, such as chlorides and chlorates, are destructive of aquatic and other plant life. There are also other components of the bleach effluent which, due to odour, appearance, salinity and also toxicity, are environmentally not acceptable.

Much research effort has been expended on the minimization of pollution caused by effluents originating from the production of bleached pulp.

The introduction of oxygen either as a first bleaching stage, or in subsequent alkali extraction stages, has substantially reduced the pollution load from pulp bleaching. spent oxygen bleach liquors can be incinerated in conjunction with spent pulping liquors. In order to achieve high brightness levels though, it is regarded as necessary to include bleach stages utilizing chlorine or chlorine compounds, with the result that pulp bleach effluents remain an environmental problem. Other bleaching processes based on ozone, peroxide or nitrous oxide provide a partial solution to the problem, but to date the elimination of chlorine-related bleaching processes has not been technically and economically feasible.

In a report by Bonsor, McCubbin and Sprague prepared for the Technical Advisory Committee, Pulp and Paper Sector of MISA, Ontario Ministry of the Environment, Toronto, Ontario, Canada and published in April 1988 under the title *Kraft Mill Effluents in Ontario*, the authors state at page 1-2 of the report:

> "In the long run, the goal should be to completely eliminate the formation of organochlorines. This would probably imply the elimination of chlorine and chlorine compounds as reagents for bleaching kraft pulp. There is no current technology proven on an industrial scale which is capable of producing highly bleached kraft pulp without the use of at least some chlorine."

An alternative approach to the elimination of chlorine-based bleaching, has been to minimize the environmental impact of such processes by avoiding effluent disposal through closing of bleach pulp mill operation via internal recycle, or by external treatment of the bleach effluents.

In this regard the Canadian report referred to above further states at page 3-45 thereof that—

> "There are a number of discussions in the literature concerning the potential of operating bleached kraft mills with little or no effluent [Environment Canada 1980], which indicate that zero effluent will not be technically feasible in the foreseeable future, but that substantial reduction in effluent flows are attainable with known technology."

Closing of the bleach pulp mill operation was originally proposed by Rapson and Reeve who pioneered counter-current washing in the bleach-plant up to the unbleached pulp stage. The process involves combining spent pulping and bleaching chemicals, concentration and incineration of the combined streams and separation of pulping and bleaching chemicals via evaporative crystallization of the pulp cooking liquor, spent bleaching chemicals being recovered in the form of sodium chloride. Practical problems experienced with this process caused it to achieve limited acceptance on Kraft pulping liquors.

The Canadian report referred to above mentions the fact that this process was installed in a full scale system at Thunder Bay but had to be abandoned inter alia as a result of corrosion.

A further proposal for minimizing the pollution problems presented by chlorine bleaching, namely external treatment, has been the object of international research. Such research has been based on existing water treatment technology and includes reverse osmosis, ultrafiltration, ion-exchange, electrodialysis and adsorbtive techniques using activated carbon, resins or other material. Some of these efforts have achieved limited application, only addressing a part of the problem such as detoxification or decolourization of a specific stream.

The need for an economically feasible bleach effluent treatment process has been a longfelt one and despite it being high on the list of priorities, no previous suggestion has presented a solution to the problem.

In a recent report by the National Council of the Paper Industry for Air and Stream Improvement Inc. [New York] published in October 1988 as Technical Bulletin No. 557 under the title "*Pulp and Paper Mill In—Plant and Close Cycle Technologies—A Review of Operating Experience, Current Status, and Research Needs*" the need to develop technologies for treating lignin, chlorinated organics, and inorganic chloride containing concentrated streams from various closed cycle technologies is placed at the top of a prioritized list of recommended areas of research. At page 49 of that report it is stated that:

> "At present the only demonstrated technology for treating these concentrated streams is through concentration in multiple-effect evaporators followed by burning in the recovery furnace. A potentially serious adverse impact of burning these concentrated streams in the recovery furnace is the increased chloride level in various process streams. The elevated chloride levels cause equipment corrosion, affect recovery furnace operations through changes in smelt viscosity and can result in increased hydrochloric emissions from the recovery furnace."

It is an object of this invention to provide a process for the treatment of effluents resulting from pulp bleaching processes utilizing chlorine and related chemicals, to recover spent bleaching chemicals therefrom and eliminate the discharge of chlorine compounds.

According to the present invention a process for the treatment of aqueous effluent derived from a chlorine or chlorine compound pulp bleaching process comprises the steps of—

[i] providing such effluent in acidic form;

[ii] raising the pH of the acidic effluent with a neutralising base capable of reacting with chlorine compounds contained in the acidic effluent to form a neutralized effluent containing a salt capable of being thermally decomposed to form hydrogen chloride and a residual base;

[iii] concentrating the neutralized effluent to form a concentrated brine by removing solvent water from the neutralized effluent;

[iv] heating the concentrated brine containing the salt to decomposition of the salt thereby releasing gaseous hydrogen chloride and forming the residual base; and

[v] recovering the released hydrogen chloride and the residual base separately from one another.

Preferably the effluent is provided in acidic form at a pH of below about 3,5 and the pH is raised to a value of between 3,5 and 9,5 with the neutralizing base.

Where use is made in this specification to expressions such as "neutralized effluent" and "neutralizing base" it is not intended to convey thereby that the effluent necessarily has a pH of exactly 7 or that the base is to be used to achieve that precise level of acidity. These expressions are to be read in their proper context in the specification to indicate that the pH of the effluent [which may be of the order of 2] is increased to a value of between about 3,5 to about 9,5 by the use of the appropriate base having the properties herein defined and that the neutralized effluent may hence still be acidic, i.e. have a pH value of less than 7. In certain pulp bleaching processes, e.g. pure $ClO_2$ bleaching, the resultant effluent emerges at a pH relatively close to neutrality. Such effluent requires to be pre-treated to lower the pH thereof so as to provide an acidic effluent. Such pre-treatment may comprise passing the "neutral" effluent through a cation exchange resin preferably to lower the pH to a value of below 3,5, the object being to remove cations, mainly sodium, to allow the replacement thereof with cations capable of forming salts which can be thermally split to release gaseous hydrogen chloride.

The neutralizing base is preferably one which forms a chloride salt capable of being decomposed to form hydrogen chloride and a residual base.

The neutralising base preferably comprises a basic compound capable of reacting with the acidic chloride containing effluent to form a chloride salt of a metal selected from the group comprising aluminium, chromium, cobalt, iron, magnesium, manganese and nickel.

The neutralizing base is preferably selected from the group comprising the hydroxides, carbonates and oxides of the group of metals mentioned above.

It is further preferred according to the invention to employ a neutralizing base which is the same as the residual base obtainable on thermal decomposition of the salt resulting from the pH adjustment. Such selection allows for the direct recirculation of the residual base to the neutralization stage.

In the most preferred form of the invention the neutralizing base is magnesium oxide [MgO].

Further motivation for the selection of MgO as the preferred neutralizing base for use in the process according to the invention will appear more fully from the description following below.

The thermal decomposition of the salt may be carried out in an incinerator at a temperature in excess of the decomposition temperature of the salt. In the case of $MgCl_2$ resulting from pH adjustment of the acidic effluent with MgO, the decomposition is typically carried out at a temperature between 350° C. and 900° C. and most preferably at a temperature about 500° C.

Although the decomposition of $MgCl_2$ to MgO and HCl starts at about 230° C., decomposition at that temperature in the presence of $CO_2$ resulting from the combustion of organic matter in the brine and/or combustion of the incinerator fuel leads to the formation of $MgCO_3$. At temperatures above 350° C. and particularly at temperatures of the order of 500° C. MgO is formed during incineration. However, since the reactivity of MgO is reduced with increasing decomposition temperature leading to overburnt MgO, the incineration is carried out at below 900° C. when $CO_2$ is present during incineration such as in an open flame incinerator.

The hydrogen chloride released during the thermal decomposition process is preferably recovered by absorbing it in water to form hydrochloric acid [HCl]. Further according to the invention the HCl so obtained may be converted into $ClO_2$ and thus re-used in the bleaching of pulp. Alternatively, the HCl may be sold.

The residual base, preferably in the form of the oxide, is preferably recovered from the incinerator residue and re-used as a neutralizing base for the purpose of adjusting the pH of further bleach effluent. Alternatively it may be sold.

The concentration of the neutralized solution may be carried out in any convenient manner. In one form of the invention the concentration of the neutralized effluent is achieved by one or more processes selected from the group of known industrial concentration processes comprising reverse osmosis, multiple effect evaporation and mechanical vapour re-compression evaporation.

However, according to a further aspect of the present invention the concentration of the neutralized effluent is effected, as least in part, by utilization of waste heat available from the pulp mill by introducing the neutralized effluent into a cooling system of the pulp mill as cooling tower make up water to form part of the coolant in the system.

For this aspect of the present invention it is preferred to employ MgO as the neutralizing base in view of the observed phenomenon, as yet unexplained, that by maintaining a substantial content of organic material in the liquor being concentrated and effecting such concentration also in the presence of magnesium ions, a substantial degree of corrosion inhibition is obtained.

This phenomenon is possibly due to the presence of magnesium ions in the solution in combination with organics, such as lignins, having enhanced corrosion inhibiting properties. The phenomenon is totally unexpected and accounts for an added benefit derived from the use of a magnesium compound neutralizing base.

Furthermore, the presence of salts in the neutralized solution reduces the solubility of oxygen therein and hence reduces the corrosiveness of the solution.

The unique composition of the neutralized solution resulting from the selection of the magnesium compound neutralizing base accordingly leads to the additional benefit of allowing the use of waste heat, where available, for concentration of the neutralized solution in a cooling tower arrangement which is conventionally present as part of the pulping plant. Such concentration thus requires no special plant and equipment. Such utilization of waste heat has not previously been suggested presumably in view of the aggressive nature of neutralized effluent obtainable by using different neutralizing bases, e.g. sodium hydroxide.

On achieving a pre-determined concentration of salts in the coolant water, the coolant is subjected to a blowdown to remove some of the partially concentrated brine and the coolant is then replenished with fresh neutralized solution as cooling tower make-up water.

The concentration stage is, however, preferably carried out in two steps and in this regard it is further preferred to combine the cooling tower concentration step with a second concentration step such as multiple effect evaporation or mechanical vapour recompression. Most preferably in the second concentration step the brine is concentrated to induce crystallisation from the solution of chloride salts of lower solubility than the chloride salts to be decomposed during the subsequent heating stage, and the crystallized salts are removed from the concentrated solution.

In this application the semi-concentrated brine may be acidified by the addition of HCl to the brine prior to final concentration. This step is carried out to convert $Mg(HCO_3)_2$ which may be present in the semi-concentrated brine to $MgCl_2$ and $CO_2$ and thereby prevent it from decomposing to insoluble $MgCO_3$ during final concentration.

Alternatively, however, the semi-concentrated brine is treated with any suitable hydroxide to increase the pH value and induce precipitation of the $MgCO_3$ which is removed from the brine prior to final concentration thereof.

The said less soluble chloride salts removed from the concentrated brine during final concentration, are preferably dissolved, passed through a cation exchange resin and the resulting HCl solution is preferably blended with the HCl resulting from the decomposition of the magnesium chloride in the concentrated brine.

However, if the HCl so obtained is not of suitable quality, it may be re-circulated to the neutralization stage and/or to the final concentration stage of the neutralized brine.

The cation exchange resin is preferably regenerated with sulphuric acid to yield an eluent of $Na_2SO_4$ in an excess of $H_2SO_4$. This eluent is preferably utilized to convert part of the residual base in the form of MgO to obtain a mixture of $MgSO_4$ and $Na_2SO_4$ which is re-circulated to the oxygen bleaching step of the bleaching process.

The balance of the MgO obtained from the thermal splitting of the salts in the concentrated brine is re-circulated to the neutralization stage.

Further according to the invention it is preferred that the liquor, subsequent to the neutralization stage, is filtered or otherwise clarified to remove insoluble fibre and precipitated organic matter before the concentration step.

To avoid chemical or thermal shock on subsequent treatment processes the neutralized effluent is preferably passed through an equalization vessel before being fed to the subsequent treatment stage.

Also according to the invention the process incorporates a biological treatment for the digestion of organic matter and the conversion of sulphates and chlorates present in the effluent respectively to sulfides and chlorides.

In a further aspect of the invention the neutralized solution is subjected to a biological treatment stage prior to concentration. The biological treatment stage is preferably an anaerobic digestion stage during which organic matter in the solution is converted into biogas containing mainly methane gas.

The anaerobic digestion is carried out using any suitable anaerobic micro-organism population capable of anaerobic digestion of organic matter and reduction of sulphates and chlorates to sulfides and chlorides respectively and the conversion of organics to methane. Sources of such microorganisms are known to those skilled in the art. Thus, for example, the organisms may be sourced from conventional sewerage plants, brewery sludge, and industrial effluent plants or combinations thereof. The microorganisms are cultivated by conventional methods and the process may be operated in the mesophylic temperature range in any suitable manner known in the art.

The methane containing biogas is preferably recovered and utilized as fuel for supplying part of the energy requirements of the effluent treatment circuit.

The anaerobic digestion stage is preferably coupled with an ultra-filtration sub-circuit during which the biomass, including the micro-organisms, is separated from the filtrate and maintained in the biodigestor vessel.

Removal of calcium sulphate is also achieved by the anaerobic fermentation of sulphates yielding hydrogen sulphide and calcium carbonate both of which may be further treated for recovery of chemicals used in pulping processes. In addition, chlorates present in the solution are, during the anaerobic digestion, converted to chlorides.

The removal of organic matter may be further enhanced by passing the anaerobically digested effluent through an aerobic digestion stage such as an activated sludge process or a packed column, with the addition of oxygen and nutrients to foster aerobic bacterial metabolism of organic matter which may be present after anaerobic digestion.

The inclusion of a biological treatment stage in the process may possibly reduce the corrosion inhibition qualities of the treated effluent and may hence call for the introduction of corrosion inhibitors or the selection of suitable corrosion resistant materials of construction.

In the preferred form of the invention the treatment process described above is applied to effluent derived from the D/C stage of a four stage pulp bleaching plant wherein the pulp is sequentially subjected to an oxygen bleach stage, a D/C stage, an E stage and a D stage and wherein counter-current washing of the pulp is effected by introducing fresh water at the D stage, introducing the effluent from the D stage as washwater to the E stage, and introducing the effluent from the E stage into the D/C stage after passing the E stage effluent through an ultra-filtration stage to remove high molecular weight lignins therefrom.

The various bleaching stages are well known in the art and are summarized below. The introduction of an ultra-filtration stage to the effluent from the E stage for the purpose of using the permeate as washwater for the D/C stage has not been suggested previously and leads to the beneficial result of substantial liquid effluent reduction. Furthermore, heat saving through the use of hot E stage permeate as washwater is realised. Ultrafiltration of hot E stage effluent is possible through the use of high temperature tolerant membranes such as polysulfone.

In order to illustrate the invention examples of the process are described below with reference to the accompanying drawings in which:

BRIEF DESCRIPTION OF THE DRAWINGS

Referring to FIG. 1, the pulping section of the mill is depicted on the left of the line X—X. It will be seen that this section of the mill features a closed circuit regeneration of pulping chemicals. The bleach plant is depicted on the right of line X—X and features a separate closed circuit for regeneration of bleaching and other chemicals according to the invention.

Figure 1:
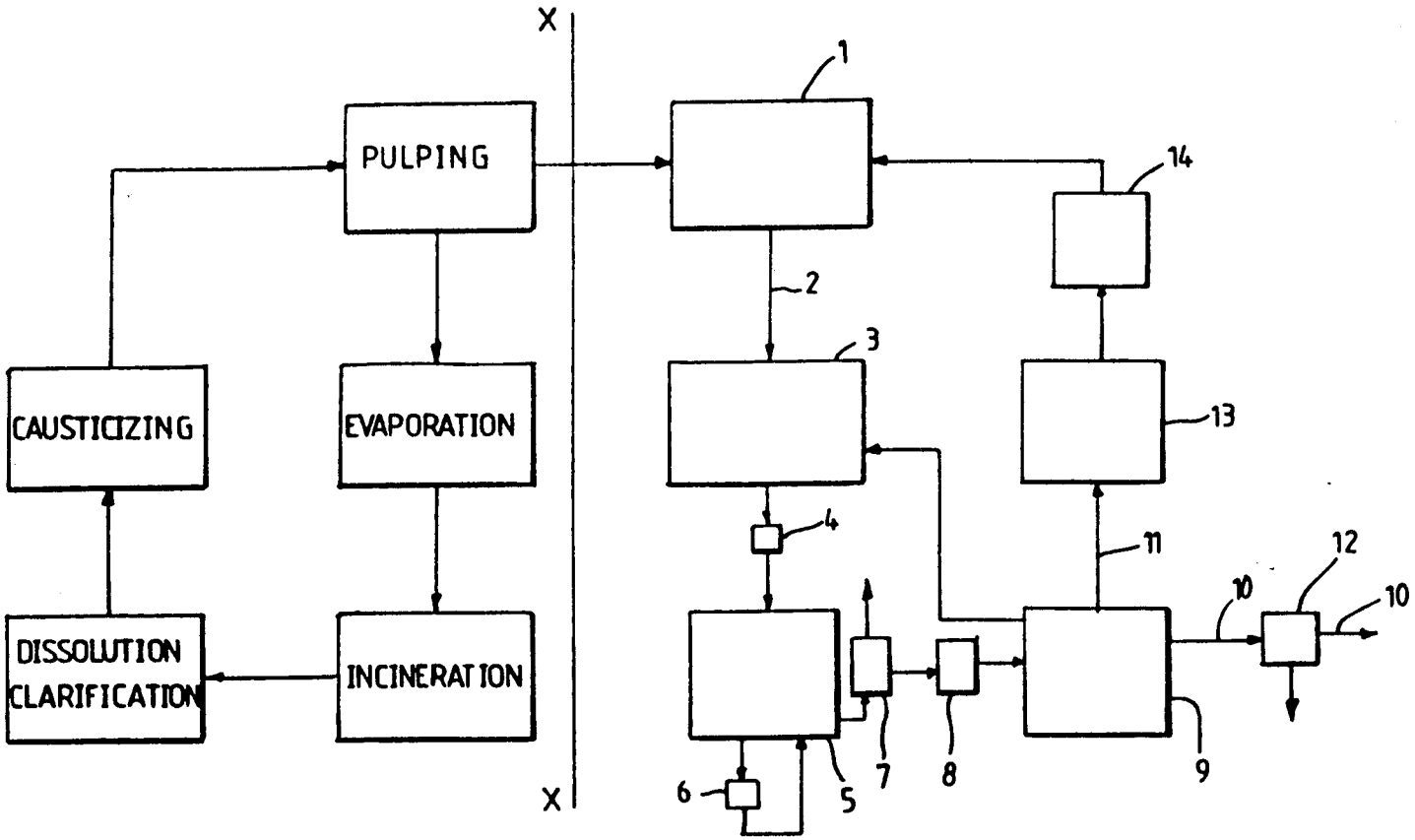
FIG. 1 is a flowsheet depicting a simplified closed-bleached Kraft pulp mill utilizing the method for the treatment of chlorine or chlorine compound bleach effluent.

Effluent originating in the bleaching mill 1, based on the use of chlorine or chlorine compounds, is passed through line 2 to a reactor 3 where the effluent is neutralized using magnesium carbonate [or oxide]. Such liquor is passed through filter 4 to remove fibre and other insoluble matter. The mill features substantial waste-heat disposal via two large cooling towers [not shown]. Cooling water is supplied to a turbo generator condensor and to large liquor evaporator surface condensors 5. Evaporated cooling water is replenished with treated bleach effluents from the filter 4 and the available waste heat is thus used to achieve bleach effluent volume reduction. It will be appreciated, however, that any means of evaporation can be applied.

Evaporation yields up to 90% volume reduction and suspended solids formed during such concentration [mainly organic] are removed via side-stream filtration 6.

Adequate corrosion inhibition is required either via appropriate materials selection, or by adequate lining such as epoxy coating, or by use of a suitable corrosion ihibitor. The lignin content of the neutralized effluent, especially in conjunction with magnesium, proved to provide substantial metal corrosion inhibition.

Cooling water concentration is controlled to minimizescaling via appropriate blow-down. Such blowdown is subjected to biological treatment in an anaerobic digestor 7 to achieve bacterial reduction of sulphate to hydrogen sulphide which is stripped from solution. The hydrogen sulphide is absorbed in alkalinic pulping liquor [not shown] to recover sulphur as the sulphide.

Up to 90% sulphate removal can be achieved in this manner as well as substantial organic removal. Sulphate removal simplifies downstream treatment and may provide for a net return due to the recovery of sulphur.

Finally the effluent stream is further concentrated using a conventional evaporator 8. Hydrochloric acid is used to control $MgCO_3$ scaling in the evaporator. The concentrated brine is incinerated at elevated temperatures in kiln 9 thermally split the magnesium chloride into magnesium oxide 10 [or $MgCO_3$ depending on the incineration temperature and amount of $CO_2$ present in the kiln] and hydrogen chloride 11. Sodium chloride contaminating the magnesium oxide may be removed and recovered by leaching 12 and the magnesium oxide may be re-cycled for bleach effluent neutralization or sold.

The hydrogen chloride 11 is scrubbed with water in absorbtion tower 13 to produce hydrochloric acid which is re-used as feed material for the manufacture of chlorine-dioxide bleach chemical in generator 14. Sodium chloride leachate can be purified to provide for feed material for a chlor-alkali plant [not shown].

In a bleach plant featuring oxygen pre-bleaching, magnesium salts are used as a protector and such magnesium is removed from the pulp via the subsequent acidic bleach effluent stream. The process thereby provides for the recovery of magnesium which can be re-processed for re-cycle.

The above concept thus provides for a closed bleach plant operation featuring chemicals re-cycled for re-use.

It will be appreciated that the process is adjustable to meet mill requirements. For example, cation-exchange may be used as a pre-treatment to remove all or a portion of the cations [mainly sodium] in order to increase the amount of hydrochloric acid produced. This may be particularly attractive in mills using chlorinedioxide bleaching only. Furthermore activated carbon or adsorbtive resins may be used to remove organic material which may cause fouling problems in the cooling water system. Some of the process steps may be eliminated such as the anaerobic sulphate removal if, for example, sulphate levels are low. The best process combination can be selected to minimize capital and operating expenses.

Figure 2:
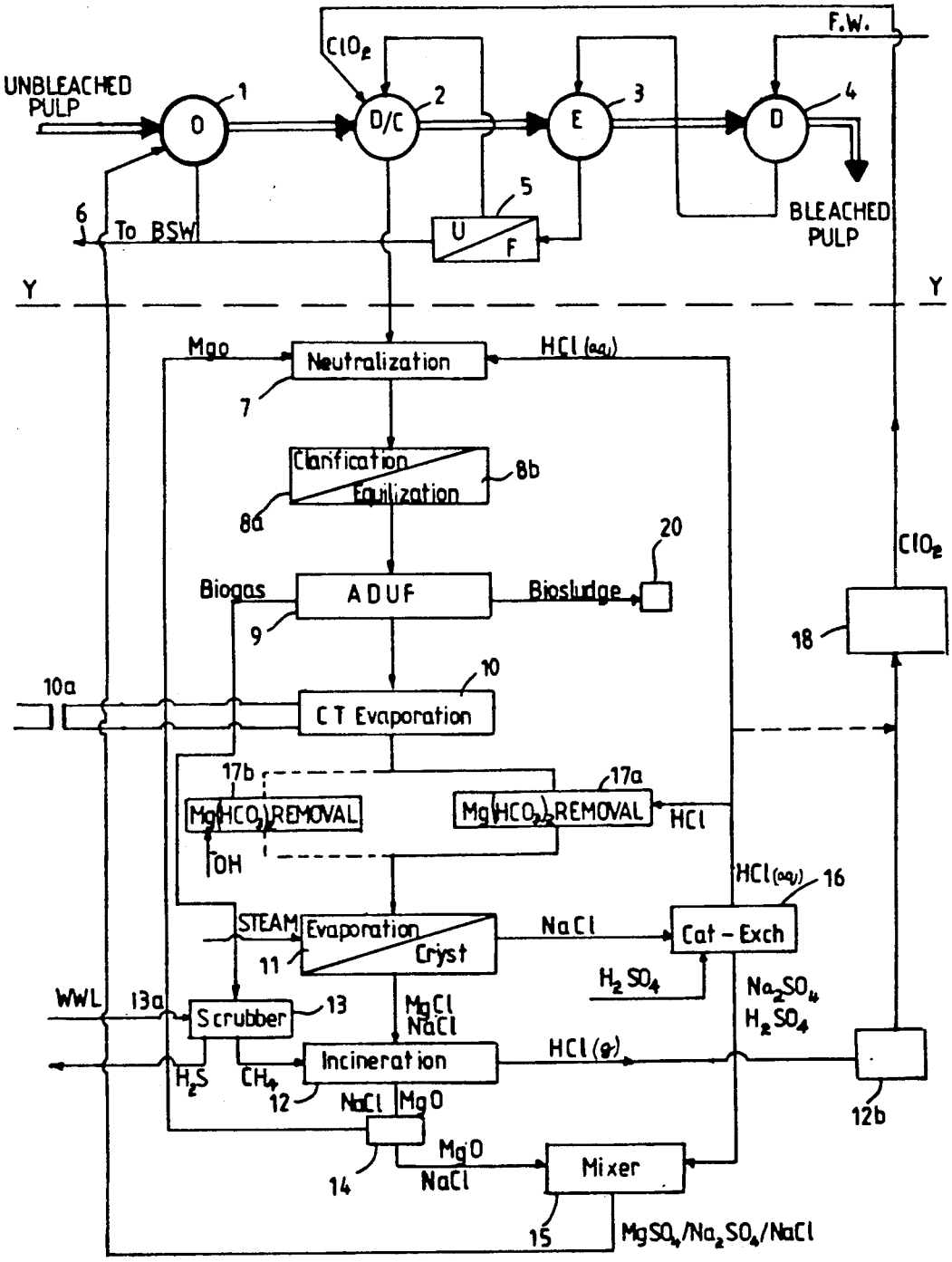
FIG. 2 is a more detailed flowsheet depicting a closed circuit for the treatment of bleach effluent and the recovery of chemicals therefrom.

Referring now to the flowsheet set out in FIG. 2 of the accompanying drawings there is illustrated a cellulosic pulp bleaching and effluent elimination process according to the invention, the bleaching stages of the process being the stages illustrated above the line Y—Y and the effluent elimination or chemical recovery stages being illustrated below that line.

The sequential bleaching stages of a four stage pulp bleaching process is shown to comprise firstly an oxygen bleaching stage 1 marked O during which the unbleached pulp is treated with oxygen in the presence of NaOH and in which stage $MgSO_4$ is added to the pulp as a fibre protector, secondly a D/C bleaching stage 2 in which the oxygen pre-bleached pulp is treated with chlorine dioxide and chlorine to attain a higher degree of brightness, thirdly an E stage 3 during which the partially bleached pulp is extracted with sodium hydroxide and fourthly a D stage 4 during which the partially bleached pulp is finally bleached with chlorine dioxide. The pulp accordingly proceeds from the oxygen bleaching stage via the D/C stage, the E stage and the D stage to emerge from the bleaching process as bleached pulp. During this bleaching process fresh water is introduced into the D stage 4 and the water follows a counter-current path relative to the pulp up to the D/C stage 2 in which counter-current arrangement the bleed from the D stage 4 is introduced into the extraction or E stage and the bleed from the E stage is introduced as washwater to the D/C stage marked 2.

In accordance with the present invention, and for the purpose of reducing the volume of liquid to be treated in subsequent stages and the elimination or reduction of the load of high molecular weight lignins which are resistant to biodegradation, it is preferred to provide an ultra-filtration stage 5 in the bleed derived from the E stage. Organic materials, such as high molecular weight lignins, which are difficult to degrade by means of biodegradation processes to be described below are removed during the ultra-filtration stage and returned to the brown stock washers of the pulping plant along with the effluent from the oxygen bleaching process 1 as indicated at 6. The filtrate from the ultra-filtration process which now has a greatly reduced organic matter load is then suitable to be utilised as washwater in the D/C stage to bring about a substantial reduction in liquid volume and energy demand compared to the earlier arrangement wherein fresh water, which had to be treated, was used as D/C stage washwater. The ultra-filtration stage is also necessary to prevent or reduce precipitation of organic material in the acidic D/C stage with countercurrent washing. Already in this step an ecological advantage is achieved over the conventional O-D/C-E-D four step bleaching processes in which the polluted effluent emerging from the E bleaching stage 3 is sewered either before or after additional treatment.

The bleed from the D/C stage is acidic and typically has a pH value of the order of 2. This bleed is, of course, rich in chlorides, chlorates and chlorinated compounds and also contains some organic materials and sodium ions. It further contains sulphate and magnesium ions originating from the oxygen bleach stage in which, as pointed out above, magnesium sulphate is added as a protector of the cellulosic fibres. During the acidic D/C stage the magnesium ions which adhere to the fibres during the oxygen bleach stage, are stripped from the fibres. The sodium ions in the bleed from the D/C stage are derived partially from the sodium hydroxide added during the oxygen bleaching stage 1 and partially from the E stage during which the pulp is extracted with sodium hydroxide.

In the preferred treatment process of the present invention the bleed from the D/C stage is pH adjusted to a pH value of between 3, 5 and 9, 5 by the addition of MgO, which forms $Mg(OH)_2$ or Milk of Magnesia on contact with the water. The effluent being neutralized is thoroughly mixed by means of any suitable mixing arrangement in a tank of suitable construction to allow the neutralization to take place.

Magnesium oxide is the neutralizing agent of choice for a number of reasons. Most important of these, as will be described in more detail below, magnesium oxide may be recovered from the magnesium chloride salt solution resulting from the neutralization reaction and hence this particular choice allows for the virtual complete recycling of magnesium oxide used for neutralisation along with the virtual complete recovery of the magnesium ions stripped from the fibres during the D/C bleaching stage. Hitherto the magnesium metal values stripped during the D/C stage were simply discarded in conventional processes. Furthermore, the formation of $MgCl_2$ salt binds the chlorine content of the bleach effluent in a form which allows for the recovery of the chlorine in the high value form of HCl by a relatively simple process. The recovery of HCl hence dispenses with or at least greatly reduces the need of releasing chlorine or chlorinated compounds into the environment in one form or another as necessarily results from conventional bleach effluent treatment processes.

It has further been found that the presence of magnesium in the neutralized solution gives rise to reduced precipitation of organic compounds during subsequent concentration stages, as will be described, when compared, for example, to calcium in cases where a calcium based neutralization base is used. It has been observed that the presence of organic materials in conjunction with magnesium in the bleach effluent provides for inhibition of corrosion of metallic plant components such as cooling towers and cooling circuits employed during concentration stages and it is therefore preferred to maintain the organic content of the composition in solution, both for reason of reducing precipitants and for the purpose of better corrosion inhibition.

Magnesium further gives rise to a reduced scaling tendency when compared, for example, to calcium. Furthermore, neutralization with magnesium oxide is a relatively fast reaction, provided the reaction mixture is thoroughly mixed. The fact that a substantial quantity of magnesium oxide is required for the neutralization to the required level of the hydrochloric acid content of the D/C bleach effluent, is not an aspect of consequence as the magnesium oxide is substantially fully recovered during subsequent stages as will be described below.

From the neutralization stage 7 the neutralized effluent is fed first into a clarifier 8*a* and from there into an equalization tank 8*b* where a relatively short retention time of a few hours is maintained. During the clarification stage most of the fibres which may have been carried forward from the bleaching process are removed by being allowed to settle out and small quantities of excess chlorine gas, which may still be present in the liquid, react with the organics present in the effluent. The most important purpose of the equalization stage 8*b*, however, is to provide for a proper mixing thereby to eliminate or minimize chemical or thermal shock at subsequent treatment stages. This is particularly important in an arrangement where the bleach effluents from several bleaching plants are combined for further treatment as described below.

The clarified and equalized effluent from stages 8*a* and 8*b* are delivered to an anaerobic digestion stage 9 which digestion stage is of a type known as an anaerobic digestion ultra-filtration [ADUF] arrangement. This process of biological degradation of the organic content in the neutralized liquid is preferred for various reasons including the fact that biodegradation by way of anaerobic digestion can take place at temperatures in the mesophylic range that is, temperatures of the order of 30° C. to 35° C., which may under appropriate conditions eliminate the need to cool the bleach effluent derived from the neutralization stage. However, should the neutralized effluent emerge from the equalization/clarification stages at a temperature above that range the temperature should be reduced or alternatively, a thermophylic anaerobic microorganism population, such as is known in the trade, should be employed. Such higher temperatures during the degradation stage inter alia gives rise to higher mean flux through the membranes of the ultra-filtration sub-cycle of the ADUF stage. The anaerobic digestion also gives rise to the generation of valuable biogas which contains mainly methane gas which is utilized as a fuel to fulfil substantially the entire energy requirements of the final concentration stage and thermal decomposition or splitting processes as will be described below. Furthermore, during the anaerobic digestion the sulphates, which are present in the effluent as a result of the addition of magnesium sulphate during the oxygen bleaching stage, are reduced to sulphides in the form of hydrogen sulphide. The removal of the sulphates not only gives rise to simplified downstream chemistry by substantially reducing calcium sulphate scaling but it also gives rise to the recovery of sulphide which may be re-cycled to the pulping circuit of plant. In addition, chlorates which are present in the effluent as a result of the D/C bleaching stage, are reduced to chlorides which also simplifies downstream chemistry and boosts the recovery of hydrochloric acid during the thermal decomposition of the concentrated bleach liquor components as will be described below. By combining the anaerobic digestion stage with an ultra-filtration stage, substantially all the biomass, including the micro-organisms in the anaerobic digestion vessel, is maintained in or re-circulated to that vessel and a substantially sterile, suspended-solids free permeate is supplied to the subsequent treatment processes.

Where required an aerobic digestion stage [not shown] may follow the anaerobic digestion stage to further reduce the organic content of this stream.

The permeate from the ultra-filtration stage of the anaerobic digestion ultra-filtration stage 9 is then stripped of part of its water content in any suitable manner known in the art for concentration of solutions. Preferably, however, the concentration is conducted in two stages.

The first stage is preferably carried out by means of a cooling tower evaporation 10 using high cycles of concentration to suppress the oxygen solubility of the solution. In practice the permeate is utilized as a coolant in a cooling system arranged to dissipate heat from a heat source 10*a*, such as a generator, and which cooling system includes a cooling tower in which water is lost as a result of evaporation during the re-cooling cycle with resultant increase in salt concentration of the coolant. The coolant is subjected to a suitable blow-down procedure to remove part of the partially concentrated coolant and the coolant is then replenished with make-up water in the form of the fresh permeate from the ADUF stage 9.

The second or final concentration stage 11 of the cooling tower blow-down brine involves the evaporation of water from the cooling tower blow-down by means of heat in a multiple effect evaporator system. The brine is concentrated to the required degree using a steam driven evaporative crystallizer to induce crystallisation of sodium chloride from the concentrated solution. Prior to final concentration the partially concentrated brine is pH adjusted to a pH value of about 4 by the addition of HCl as shown at 17*a* for the reasons as will be described below. Alternatively, the semi-concentrated brine is treated with a suitable hydroxide to convert the $Mg(HCO_3)_2$ into insoluble $MgCO_3$ which is precipitated and removed from the brine as illustrated at 17*b*.

The brine now containing mainly magnesium chloride and a relatively small quantity of sodium chloride [assuming sodium chloride crystallisation to have occurred at the final concentration stage 11] is then incinerated in the incineration stage 12 at a temperature of about 500° C. but in any event not below 350° C. and not above 900° C. The methane gas derived from the anaerobic digestion ultra-filtration stage 9 as part of the biogas is utilized as the fuel. The biogas is preferably separated beforehand in a scrubber, indicated at 13, to separate the hydrogen sulphide from the methane, the hydrogen sulphide being absorbed into the weak white liquor stream of the pulping plant and returned to the pulping circuit of the plant as illustrated at 13*a*.

On incineration in stage 12 magnesium chloride is thermally split or decomposed into hydrogen chloride gas [HCl] and magnesium oxide [MgO] powder.

The bulk of the magnesium oxide recovered from the leaching process is re-circulated to the neutralization stage 7 thus largely completing the magnesium cycle. The balance of the magnesium content of the brine eventually ends up in the oxygen bleach process as will be described below. The hydrogen chloride gas derived from the incineration process is captured as hydrochloric acid by absorbing it in water as shown at 12*b* and the acid so obtained is conveyed to the $ClO_2$ plant 18 to be converted into $ClO_2$ in the conventional manner for re-use in the D/C stage and D stage of the bleaching process thereby largely completing the chlorine cycle in the plant and reducing or eliminating the need to purchase the full requirement of the chlorine required to produce chlorine dioxide.

The completion of the chlorine cycle insofar as it relates to chlorine values recovered in the form of crystallized NaCl from the crystallization stage 11 is described below.

The sodium chloride crystallized during the final concentration stage 11 is dissolved and preferably passed through a cation exchange reactor 16 to produce hydrochloric acid which is either blended with the HCl from the thermal splitting stage or re-circulated to the neutralization stage for the subsequent recovery of the chlorine content as hydrochloric acid as described above. It is also necessary to re-cycle some of the hydrochloric acid so obtained into the brine immediately preceeding the final concentration stage 11 for the purpose of converting any $Mg(HcO_3)_2$ present therein to $MgC1_2$ to prevent the thermal decomposition of the former to insoluble $MGCO_3$ which will otherwise form on and scale the evaporator. This addition of HC1 to the semi-concentrated brine is illustrated in FIG. 2 at 17. By this re-circulation of HC1 to the neutralization stage 7 and to the semi-concentrated brine as shown at 17, the chlorine cycle is completed.

Part of the MgO produced during incineration is also split off as shown at 14 to be fed to the mixer 15. The quantity so split off is determined by the amount of $H_2SO_4$ which emerges as the eluent from regeneration of the cation exchange resin and the amount of $MgSO_4$ required for protecting fibres during the oxygen bleach process as will be apparent from what follows below. Also fed to the mixer 15 is the eluent resulting from the regeneration of the cation exchange resis of stage 16 with $H_2SO_4$ which eluent is not enriched with $Na_2SO_4$ and also contains excess $H_2SO_4$. In the mixer 15 excess $H_2SO_4$ reacts with the $Mg(OH)_2$ and MgO to give rise to a solution containing mainly $Mg^{++}$, $SO_4^{=}$ and $Na^+$ ions along with a small quantity of $Cl^-$ ions, which solution is returned to the oxygen bleaching stage 1 of the bleaching process thereby completing both the magnesium and chlorine circuits of the process and providing the required magnesium protection of the fibres during that bleaching stage. The use of $H_2SO_4$ as cation exchange resin regenerant enables the recovery of sodium sulphate which passes through the oxygen bleaching stage and the brown stock washer to provide for a salt cake made up to the pulp chemicals circuit.

It will be seen that the only waste product from the treatment process described above is a small quantity of biosludge 20 resulting from the anaerobic digestion stage 9. In a typical application of the invention is is projected that from a daily throughput of about 7 500 $m^3$ of D/C effluent per day, the amount of HCl to be recovered would be of the order of 26 tons per day and the amount of MgO of the order of 8.5 tons per day. Compared to these amounts the projected one ton per day of biosludge containing relatively small quantities of $CaCO_3$, silicon and some heavy metals is clearly insignificant. The sludge may of course be incinerated or disposed of in another suitable manner.

Thus the process allows for the substantially complete recovery of the bleaching chemicals and neutralizing base. It also utilizes the methane gas generated by digestion of the organic content of bleach effluent as an energy source for providing the heat required during the final concentration stage and the thermal splitting of the $MgCl_2$ brine into MgO and HCl. Furthermore, excess heat from any heat generating source is utilized in the first evaporation stage. Accordingly the process described above virtually eliminates all environmental impact of the conventional chlorine based paper pulp bleaching process.

Other process combinations are possible, but the above examples illustrate the feasibility of closed bleach pulp plant operation by the process of the invention. Compared to past efforts to treat pulp and bleach mill effluents together, the separate closure of bleach plant operation according to the invention simplifies the treatment of bleach effluent in order to avoid wastage of chemicals and pollution problems.

With steadily rising raw material and effluent treatment costs, as well as ever-increasing environmental constraints through increasingly rigid legislation, the process of the invention provides for a technically sound and economically feasible method to minimize the environmental impact of chlorine-based bleaching processes.

We claim:

1. A process for the treatment of aqueous effluent derived from a chlorine or chlorine compound pulp bleaching process comprising the steps of:

(i) providing such effluent in acidic form;

(ii) raising the pH of the acidic effluent with a neutralizing base capable of reacting with chlorine compounds contained in the acidic effluent to form a neutralized effluent containing a salt capable of being thermally decomposed to form hydrogen chloride and a residual base, said neutralizing base being selected from the group consisting of carbnates, hydroxides and oxides capable of reacting with the acidic chlorine containing effluent to form a chloride salt of a metal selected fromthe group consisting of aluminim, chromium, cobalt, iron, magnesium, manganese and nickel;

(iii) clarifying the neutralized effluent to remove insoluble fiber and precipitated organic matter, and then concentrating the neutralized and clarified effluent to form a concentrated brine by removing solvent water from the neutralized effluent;

(iv) heating the concentrated being containing the salt to decomposition of the salt thereby releasing gaseous hydrogen chloride and forming the residual base; and (v) recovering the released hydrogen chloride and the residual base separately from one another.

2. A process for the treatment of aqueous effluent derived from a chlorine or chlorine compound pulp bleaching process of a pulp mill comprising the steps of:

(i) providing such effluent in acidic form;

(ii) raising the pH of the acidic effluent with a neutralizing base capable of reacting with chlorine compounds contained in the acidic effluent to form a neutralized effluent containing a salt capable of being thermally decomposed to form hydrogen chloride and a residual base, said neutralizing base being selected from the group consisting of carbonates, hydroxides and oxides capable of reacting with the acidic chlorine containing effluent to form a chloride salt of a metal selected from the group consisting of aluminum, chromium, cobalt, iron, magnesium, manganese and nickel;

(iii) concentrating the neutralized effluent to form a concentrated brine by removing solvent water from the neutralized effluent, said concentrating being effected, at least in part, by introducing the neutralized effluent into a cooling system of the pulp mill as cooling tower make-up water;

(iv) heating the concentrated brine containing the salt to decomposition of the salt thereby releasing gaseous hydrogen chloride and forming the residual base; and (v) recovering the released hydrogen chloride and the residual base separately from one another.

3. A process for the treatment of sodium and chloride rich aqueous effluent derived from a chlorine or chlorine compound pulp bleaching process in which a sodium alkali is used for extraction of lignin from the pulp comprising the steps of:

(i) providing such effluent in acidic form;

(ii) raising the pH of the acidic effluent with a magnesium base capable of reacting with chlorine compounds contained in the acidic effluent to form a neutralized effluent containing magnesium chloride;

(iii) concentrating the neutralized effluent to form a concentrated brine by removing solvent water from the neutralized effluent and thereby inducing crystallization of sodium chloride from the concentrated brine and removing the crystalized sodium chloride from the concentrated brine;

(iv) heating the concentrated brine containing the magnesium chloride to decomposition thereby releasing gaseous hydrogen chloride and magnesium oxide; and (v) recovering the released hydrogen chloride and the residual magnesium oxide separately from one another.

4. The process of claim 3 wherein the effluent is provided in acidic form at a pH of below about 3.5 and the pH is raised to a value of between 3.5 and 9.5 with the magnesium base.

5. The process of claim 4 wherein the magnesium base is selected from the group consisting of the carbonates, hydroxides and oxides of magnesium.

6. The process of claim 5 wherein the neutralizing base is magnesium oxide.

7. The process of claim 3 wherein the thermal decomposition of the magnesium oxide is carried out in an incinerator at a temperature in excess of the decomposition temperature of the magnesium chloride.

8. The process of claim 7 wherein the thermal decomposition is carried out in an incinerator at a temperature between 350° C. and 900° C.

9. The process of claim 3 wherein the hydrogen chloride released during thermal decomposition process is absorbed in water to form hydrochloric acid.

10. The process of claim 9 wherein the HCl is converted into $ClO_2$ and used in the bleaching process.

11. The process of claim 3 wherein the magnesium oxide is recovered from the incinerator residue and used to adjust the pH of fresh bleach effluent.

12. The process of claim 3 wherein the concentration of the neutralized effluent is achieved by one or more processes selected from the group consisting of reverse osmosis, multiple effect evaporation, mechanical vapour re-compression evaporation and cooling tower evaporation.

13. The process of claim 12 wherein the concentration of the neutralized effluent is effected, at least in part, by cooling tower evaporation by introducing the neutralized effluent into a cooling system of a pulp mill as cooling tower make-up water to form part of the coolant in the system and thereby to remove solvent water through evaporation in the cooling tower.

14. The process of claim 13 wherein, on achieving a pre-determined concentation of salts in the coolant water, the coolant is subjected to a blow-down to remove some of the partially concentrated brine and the coolant in the system is replenished with fresh neutralized effluent as cooling tower make-up water.

15. The process of claim 14 wherein the concentration stage is carried out in two steps by subjecting the partially concentated brine removed from the cooling tower concentration step to a second concentration step selected from multiple effect evaporation and mechanical vapour reompression.

16. The process of claim 15 wherein the partially concentrated brine derived from the cooling tower concentration step is acidified by the addition of HCl to the brine prior to final concentration.

17. The process of claim 3 wherein the sodium chloride removed from the concentrated brine is dissolved, and the solution is passed through a cation exchange resin to convert the sodium chloride to hydrochloric acid.

18. The process of claim 17 wherein the cation exchange resin is regenerated with sulphuric acid to yield an eluent of $Na_2SO_4$ is an excess of $H_2SO_4$.

19. The process of claim 18 wherein the bleach effluent treated includes magnesium derived from an oxygen bleaching process and wherein the eluent from the cation exchange resin regeneration is reacted with a part of the MgO to convert the eluent to a mixture of $MgSO_4$ and $Na_2SO_4$ which mixture is then fed to the oxygen bleaching step of the bleaching process.

20. The process of claim 16 wherein the sodium chloride removed from the concentrated brine is dissolved, and the solution is passed through a cation exchange resin to convert the sodium chloride to hydrochloric acid; and wherein part of the hydrochloric acid obtained from the cation exchange step is used to acidify the partially concentrated brine and the balance is fed to the neutralization stage.

21. The process of claim 3 wherein the process incorporates a biological treatment of the neutralized effluent prior to concentration for the digestion of organic matter.

22. The process of claim 21 wherein the biological treatment stage comprises an anaerobic digestion stage during which organic matter in the solution is converted into biogas containing mainly methane gas.

23. The process of claim 22 wherein methane containing biogas is recovered and burned as fuel for supplying part of the energy requirements of the effluent treatment circuit.

24. The process of claim 22 wherein the anaerobically digested effluent is passed through an aerobic digestion stage with the addition of oxygen and nutrient to instigate and foster aerobic bacterial metabolism of organic matter which may be present after anaerobic digestion.

25. The process of any one of claim 3 wherein the effluent is derived from the DC stage of a four stage pulp bleaching plant wherein the pulp is sequentially subjected to an oxygen bleach stage, a D/C stage, an E stage and a D stage and wherein counter-current washing of the pulp is effected by introducing fresh water at the D stage, introducing the effluent from the D stage as washwater into the E stage, and introducing the effluent from the E stage as washwater to the D/C stage.

* * * * *

UNITED STATES PATENT AND TRADEMARK OFFICE

CERTIFICATE OF CORRECTION

PATENT NO. : 5,127,992

DATED : July 7, 1992

INVENTOR(S) : Davies et al

It is certified that error appears in the above-indentified patent and that said Letters Patent is hereby corrected as shown below:

On the title page
Column 2, after "4,268,350 5/1981 Mansson.....162/29" insert -- 196,645 7/1979 Schmied et al. --

| | |
|---|---|
| Column 7, line 43 | Delete "mizescaling", insert therefor -- mize scaling -- |
| Column 12, line 41 | Delete "resis", insert therefor -- resin -- |
| Claim 1: Column 13, line 39 | Delete "carb-", insert therefor -- carbo- -- |
| Claim 1: Column 13, line 43 | Delete "aluminim", insert therefor -- aluminum -- |
| Claim 1: Column 13, line 50 | Delete "being", insert therefor -- brine -- |

UNITED STATES PATENT AND TRADEMARK OFFICE

CERTIFICATE OF CORRECTION

PATENT NO. : 5,127,992

DATED : July 7, 1992

INVENTOR(S) : Davies et al

It is certified that error appears in the above-indentified patent and that said Letters Patent is hereby corrected as shown below:

| | | |
|---|---|---|
| Claim 7: | Column 14, line 51 | Delete "oxide", insert therefor -- chloride -- |
| Claim 18: | Column 15, line 33 | Delete "is", insert therefor -- in -- |
| Claim 25: | Column 16, line 30 | Delete "DC", insert therefor -- D/C -- |

Signed and Sealed this

Fifth Day of October, 1993

Bruce Lehman

*Attest:*

BRUCE LEHMAN

*Attesting Officer*

*Commissioner of Patents and Trademarks*